United States Patent [19]

Hackenbeck et al.

[11] Patent Number: 4,544,106

[45] Date of Patent: Oct. 1, 1985

[54] SUCTION APPARATUS FOR REMOVING FIBER MATERIAL IN A BALE OPENER

[75] Inventors: Dietmar Hackenbeck, Viersen; Hans-Jürgen Marx, Jüchen, both of Fed. Rep. of Germany

[73] Assignee: Trützschler GmbH & Co. Kg, Monchen-Gladbach, Fed. Rep. of Germany

[21] Appl. No.: 516,348

[22] Filed: Jul. 22, 1983

[30] Foreign Application Priority Data

Jul. 29, 1982 [DE] Fed. Rep. of Germany ..... 3228343
Jun. 16, 1983 [DE] Fed. Rep. of Germany ..... 3321802

[51] Int. Cl.[4] ..... B02C 19/12
[52] U.S. Cl. ..... 241/101 A; 19/80 R; 241/101.7
[58] Field of Search ..... 241/101 A, 101.7, 101.2; 198/632, 700, 750, 778; 19/80 R, 80 A, 82, 83, 81

[56] References Cited

U.S. PATENT DOCUMENTS 3,498,482 3/1970 Lewis ..... 198/750 X
4,365,764 12/1982 Marx .
4,498,215 2/1985 Hergeth et al. ..... 241/101 AX

FOREIGN PATENT DOCUMENTS 3032584 6/1982 Fed. Rep. of Germany .
8213273 6/1983 Fed. Rep. of Germany .

*Primary Examiner*—Mark Rosenbaum
*Attorney, Agent, or Firm*—Spencer & Frank

[57] ABSTRACT

A fiber bale opener includes a truck arranged for back-and-forth movement along a traveling path, for removing fibers from bales arranged along the traveling path. The bale opener further includes a stationary suction duct extending in the direction of the travelling path and having a throughgoing slot on one side thereof, extending parallel to the traveling path. A flexible cover belt extends over the slot for sealing the inside of the duct from the environment and defining an interstice within the truck. The interstice travels with the truck and provides a passage for the fiber to pass inside of the suction duct. A deflection roller is fixed to the truck and the cover belt is positioned above the slot and is divided into an upper and lower section with the lower section covering the longitudinal slot. The cover belt has one end fixed at one end of the traveling path and is guided around the deflection roller. A device for winding and unwinding the cover belt is provided which includes a rod or tube shaped core around which the cover belt can be wound and the upper section of the cover belt extends from the deflection roller to the winding and unwinding device.

18 Claims, 7 Drawing Figures

SUCTION APPARATUS FOR REMOVING FIBER MATERIAL IN A BALE OPENER

BACKGROUND OF THE INVENTION

The present invention relates to an apparatus for removing fiber-like material by suction, particularly in a bale opener of the type having a stationary suction duct which, along its upper side, has a continuous longitudinal slot covered by a flexible cover belt, whereby the interior of the suction duct is sealed against outside air. The cover belt leaves open a reciprocatingly movable interstice through which the fiber tufts are introduced into the suction duct.

In a known apparatus of the above outlined type the cover belt is fastened at both its ends and is trained about deflecting rollers at the head of the suction duct. The cover belt extends in two superposed layers from the deflection roller on one side of the interstice to a deflection roller at one end of the traveling path of the bale opener and from the deflection roller at the other side of the interstice to the other end of the traveling path. While this arrangement which is disclosed in U.S. Pat. No. 4,365,764, is an improvement over other prior art devices, if a plurality of textile fiber bales, for example, a set of 50 freestanding bales, are to be processed in sequence, a correspondingly long cover belt may be difficult to handle.

SUMMARY OF THE INVENTION

It is therefore the object of the present invention to provide an apparatus of the above-mentioned type from which the discussed drawbacks are eliminated and which permits covering a long suction channel with the belt in a simple and problem-free manner.

This object and others to become apparent as the specification progresses, are accomplished by the invention, according to which, briefly stated, the upper layer of the cover belt extends from a deflection roller at the interstice to a winding and unwinding device which includes a rod or tube-shaped core around which the cover belt can be wound.

Due to the fact that the upper layer of the cover belt can be wound around and unwound from the core, a substantially shorter cover belt can be used since it is no longer necessary to loop the cover belt around the end of the travel path and bring it back below the suction duct. By winding and unwinding the cover belt, a shorter belt can be utilized which is less costly and more easily managed in operation. Moreover, space is saved which had to be utilized for the accommodation of the cover belt. Additionally, the need for setting the direction of movement of the belt is eliminated, particularly in the zone of the deflection rollers disposed at the head ends of the apparatus. In this way, a machine having a significantly longer traveling path can be realized which can process a larger number of bales, for example, 80 bales.

The deflection roller may be connected axially with two running wheels of the belt carriage. Due to the fact that the deflection roller is driven by the bale opener drive by way of a suitable transmission gear, a separate drive motor is not required. The winding and unwinding device is disposed in a carriage and is pulled and pushed, respectively, like a trailer. A further advantage is that the winding and unwinding device winds and unwinds at the same speed as the speed of travel of the carriage. Advantageously, the deflection roller has a freewheel arrangement which is utilized during the winding process. This compensates for the slippage between the deflection roller and a first winding roller so that the cover belt remains tensioned. Preferably, a step-up gear is utilized for the drive from the deflection roller to the first winding roller, that is, the deflection roller rotates slower than the first winding roller. This permits a tighter winding of the cover belt. Advisably, a second winding roller has an associated freewheel arrangement for compensating for the slippage during the unwinding process. Preferably, the second winding roller is provided with a brake, such as a laminar brake or a disc brake, so that excessive speed during unwinding is avoided. The brake may be disposed on the second winding roller coaxially therewith or may be spatially axially offset from the second winding roller. A supporting roller presses onto the lower section of the cover belt so as to prevent the cover belt from breaking out. Additionally, the support roller may be connected axially with two of the running wheels of the belt carriage.

DESCRIPTION OF THE PREFERRED EMBODIMENTS

Figure 1:
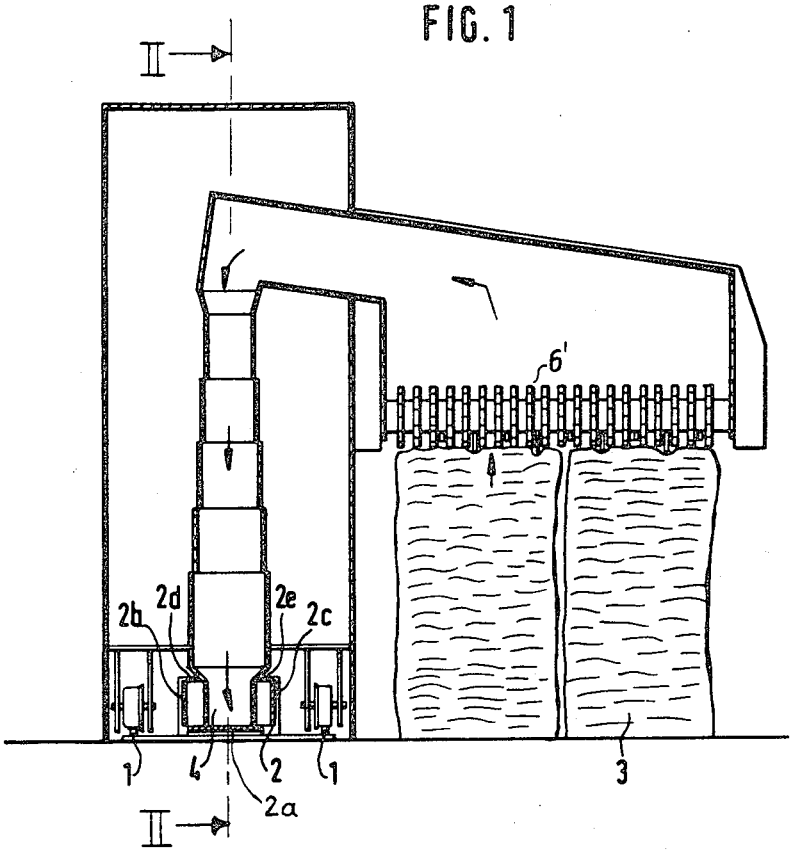
FIG. 1 is a sectional front elevational view of a bale opener incorporating a preferred embodiment of the invention taken along line I—I of FIG. 2.

Turning to FIG. 1, there is shown a bale opener which may be a BLENDOMAT model, manufactured by Trützschler GmbH & Co., KG, Mönchengladbach, Federal Republic of Germany. The bale opener includes a truck 6 traveling back and forth on rails 1 supported on the floor. Arrow 13 indicates the working (operating) direction, while arrow 14 indicates the return direction of the truck 6. A bale opener having a traveling truck that works during travel in both directions (that is, which removes fiber from bales as it travels from either end of the rails towards the other end) may also be used. The truck 6 carries an opening mechanism 6' for removing fiber material from fiber bales 3 lined up along the rails 1.

The bale opener includes a suction duct 2, through which the tufts taken from bales 3 are removed by suction, and which is disposed between the rails 1. The suction duct 2 comprises a metal bottom sheet **2*a* two side walls 2*b*, 2*c* and a two-part metal cover sheet 2*d*, 2*e*. The two parts 2*d*, 2*e* of the metal cover sheet are spaced from one another to define a continuous longitudinal slot 4 whose length extends perpendicularly to FIG. 1**.

Figure 2:
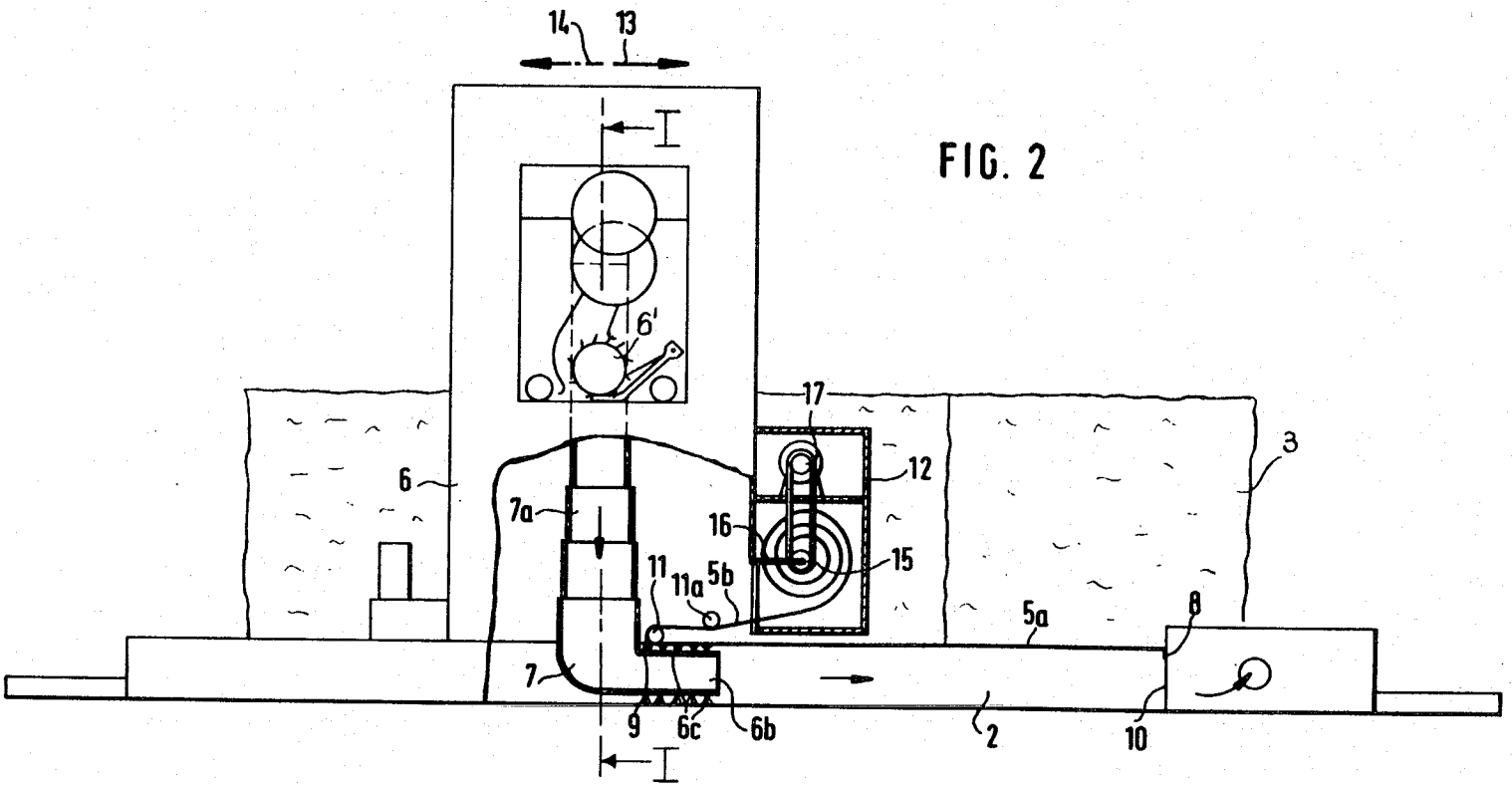
FIG. 2 is a sectional view taken along line II—II of FIG. 1.

Referring now to FIG. 2, the top side of suction duct 2 is closed by a cover belt 5 which is arranged in a lower layer **5*a* and an upper layer 5*b* and which is guided in such a manner as to define an interstice 7 which is part of longitudinal slot 4. The interstice 7 is situated within the confines of the truck 6 and moves in unison with the truck 6 as the latter executes its back-and-forth travel on the rails 1. Through the interstice 7** there passes a telescoping tube *7a* through which the tufts gain access to suction duct 2. The telescoping pipe *7a* opens into an open funnel *7b* leading to suction channel 2. Funnel *7b* is sealed against the layer *5a* of cover belt 5 and against the inner wall of the suction duct 2 by means of brushes *7c*. The two layers *5a, 5b* of cover belt 5 are disposed above the longitudinal slot 4. The lower layer *5a*, which covers longitudinal slot 4, is fastened fixedly at its one end in the region of head end 10 of suction duct 2 and its other end 9 is guided around deflection roller 11. The upper layer *5b* extends from deflection roller 11 to the winding and unwinding device 12 and is movable longitudinally therebetween. Between deflection roller 11 and winding and unwinding device 12 there is provided a tensioning roller *11a*. The winding and unwinding device 12 is provided with a central rod-shaped core 15 which is fastened by way of mount 16 at the truck 6 of the bale opener. The core 15 is rotatably mounted and is driven by a motor 17 so that the cover belt 5 can be wound onto and unwound from core 15.

Figure 3:
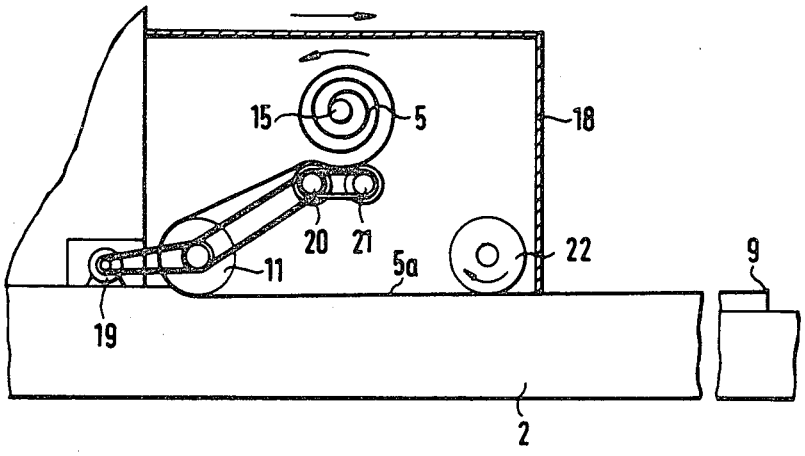
FIG. 3 is a schematic side elevational view of a component of a preferred embodiment of the invention.

FIG. 3 shows the winding and unwinding device 12, positioned in a belt carriage 18, during the winding process, that is, when the lower section *5a* of cover belt 5 is released (rolled up) from the longitudinal slot of the suction duct 2. Deflection roller 11 is driven by the drive motor 19 of the bale opener. Between deflection roller 11 and core 15 there is disposed a first winding roller 20 which is connected to be driven together with deflecting roller 11. The drive from the deflection roller 11 to the first winding roller 20 is effected via step-up gears. The first winding roller 20 is connected to be driven together with a second winding roller 21. The first winding roller 20 and the second winding roller 21 support the cover belt 5 wound around core 15. Both rollers 20 and 21 rotate with the same rpm. Between the point where cover belt 5 is fixedly secured in the region of head section 10, designated at point 9 in FIG. 3, and deflection roller 11, there is provided a counter supporting roller 22 for the lower section *5a* of cover belt 5.

Figure 4:
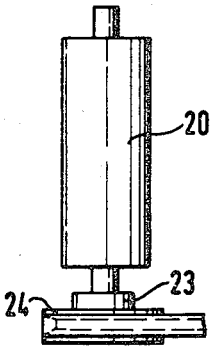
FIG. 4 is a schematic top plan view of a part of the structure shown in FIG. 3.
Figure 5:
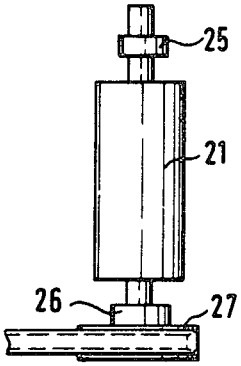
FIG. 5 is a schematic top plan view of another part of the structure shown in FIG. 3.

According to FIG. 4, the deflecting roller 11 is axially connected with a freewheel arrangement 23 having an associated drive disc 24. FIG. 5 shows the second winding roller 21 which is axially connected with a brake 25 on one side and with a freewheel arrangement 26 on the other side, with the freewheel arrangement 26 having an associated drive disc 27.

Figure 6:
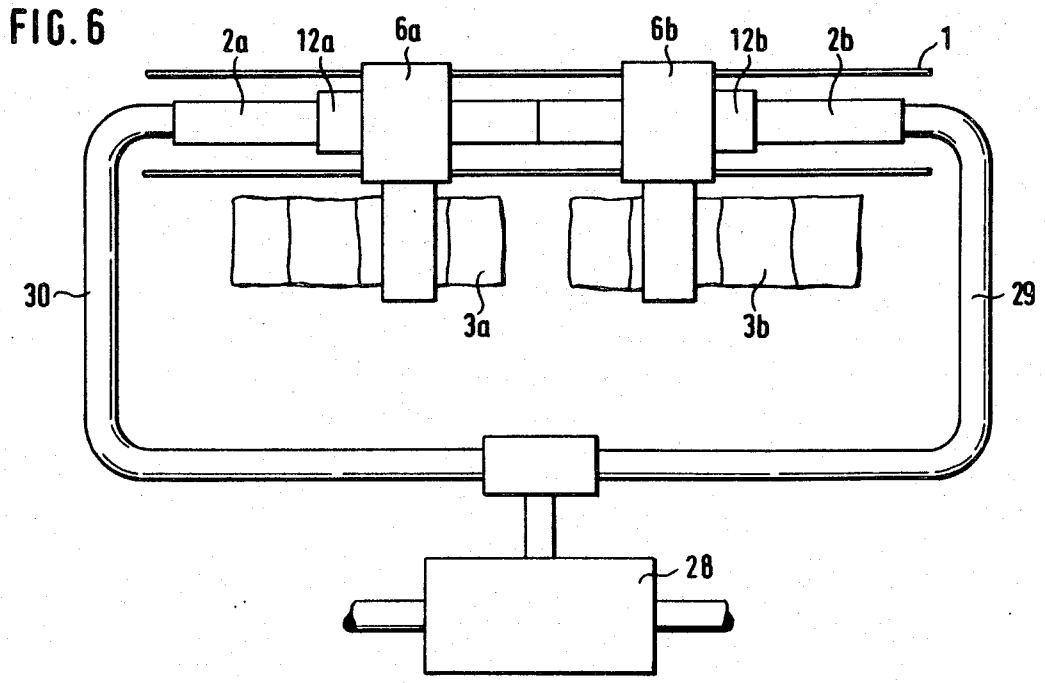
FIG. 6 is a schematic top plan view of a system incorporating the invention and having two bale openers which can be moved in the same operating direction.

FIG. 6 shows two bale openers moving on the same pair of rails 1. Each truck *6a, 6b* has its own associated winding and unwinding device *12a* and *12b*, respectively. While the first bale opener processes, for example, cotton bales *3a*, the second bale opener handles, for example, synthetic fiber bales *3b*. The head ends of suction ducts *2a, 2b* are connected, via conduits 29, 30 and possibly via dosaging devices and transport blowers (not shown), with a common mixer 28 so that a predetermined mixture of cotton and synthetic fibers may be simultaneously produced.

Figure 7:
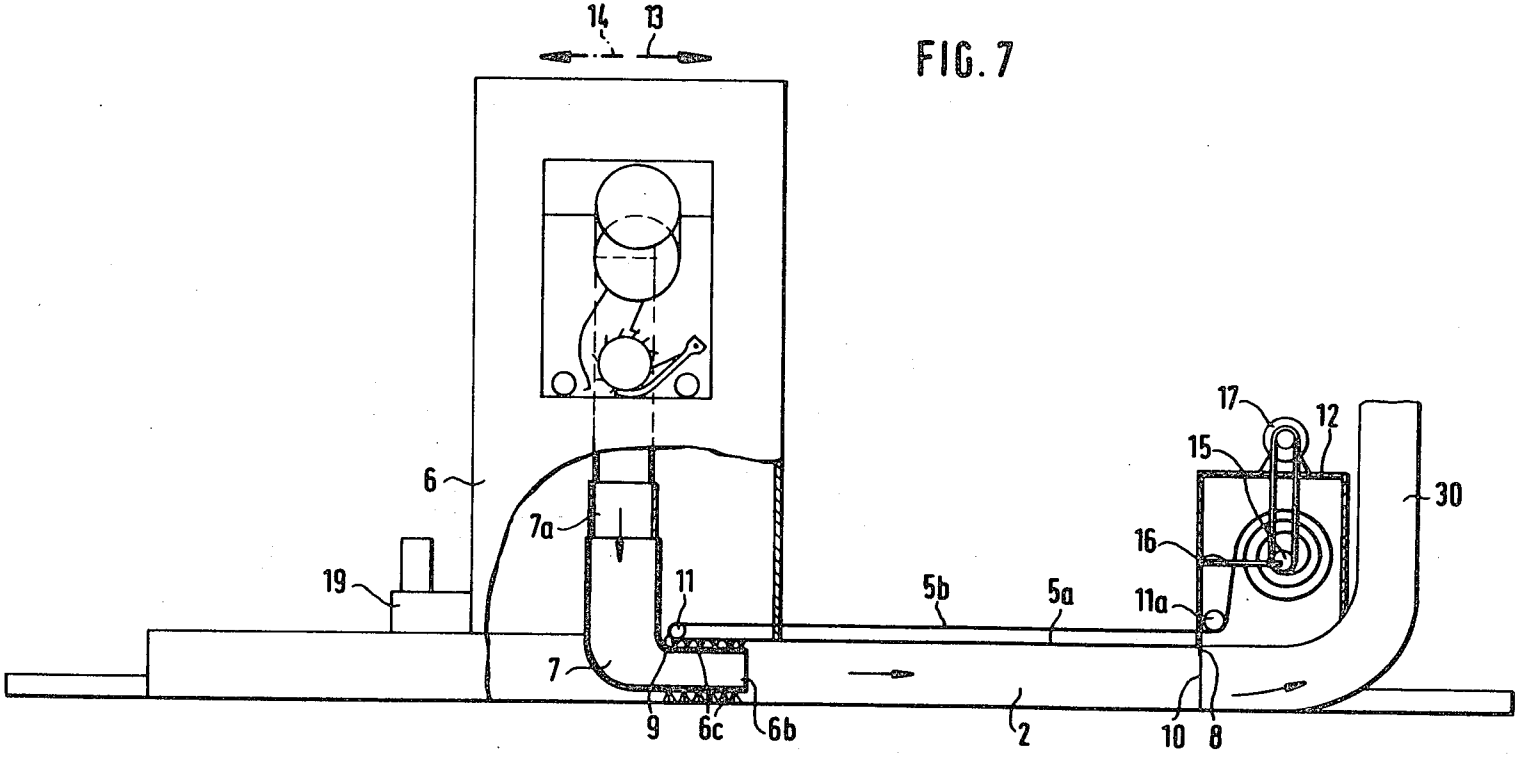
FIG. 7 is a view, similar to FIG. 2, of another preferred embodiment of the invention.

FIG. 7 shows an embodiment similar to that of FIG. 2 except that the winding and unwinding device 12 is disposed stationarily in the region of the head end 10 of the suction duct 2. This is advantageous since it eliminates the need to transport the winding and unwinding device 12 with the wound belt 5 and its drive motor 17 and, moreover, less space is required in the region of the truck 6. In particular, if an electric eye security system is provided, for example according to German Patent No. 3,032,584, the beam path which passes through an opening in the truck 6, remains unobstructed.

In both embodiments (FIGS. 2 and 7), the longitudinal half of cover belt 5, which is closer to core 15, is designed as a lightweight, thin tension belt so that the overall diameter of belt 5 is reduced when the cover belt is wound onto core 15. This half of the belt can be lightweight and thin since it needs to absorb principally tension forces which act in the longitudinal direction. Practically no transverse forces act on this half of the cover belt 5. The other longitudinal half of cover belt 5 which has its end 8 fastened to head end 10, is designed as a transversely stable belt, for example, a thicker rubber belt that is reinforced with transversely disposed steel elements. This second longitudinal half, when it rests on suction duct 2, must be able to withstand the forces of the vacuum stream in suction duct 2. These forces act on suction duct 2 primarily in the transverse direction. As soon as cover belt 5 has been brought around deflection roller 11 and becomes part of the upper belt section (layer) *5b*, it is practically only affected by longitudinal forces.

It will be understood that the above description of the present invention is susceptible to various modifications, changes and adaptations, and the same are intended to be comprehended within the meaning and range of equivalents of the appended claims.

What is claimed is:

1. In a fiber bale opener including a truck arranged for back-and-forth movement along a traveling path, an opening mechanism carried by said truck for removing fiber material from fiber bales and a suction apparatus including a stationary suction duct having a length extending in the direction of said traveling path and a throughgoing slot on one side thereof, extending parallel to said length, a flexible cover belt extending over said slot for sealing the inside of said duct from the environment, said cover belt defining an interstice within said truck; said interstice traveling with said truck and providing a passage for the fiber-like material to pass inside of said suction duct; a deflection roller mounted on said truck at the interstice; said cover belt being positioned above said slot and being divided into an upper and lower section or layer with said lower section covering said longitudinal slot; said cover belt being guided around said deflection roller and having one end fixed at one end of said traveling path; the improvement comprising a winding and unwinding device situated at a distance from said deflection roller in a direction of the traveling path; said device including a rod-like core around which said cover belt can be wound; said upper section of said cover belt extending from said deflection roller to said device and being connected to said core.

2. A fiber bale opener as defined in claim 1, wherein the winding and unwinding device is movable along said traveling path.

3. A fiber bale opener as defined in claim 1, further comprising motor means for driving said core.

4. A fiber bale opener as defined in claim 1, further comprising a motor for driving said truck along said traveling path and wherein said deflection roller is driven by said motor.

5. A fiber bale opener as defined in claim 1, further comprising a freewheel connected to said deflection roller and drive means connected to said freewheel for rotating said deflection roller when said device winds said cover belt.

6. A fiber bale opener according to claim 1, further comprising a winding roller positioned between said deflection roller and said core; motor means for driving said deflection roller; said winding roller being driven from said deflection roller.

7. A fiber bale opener according to claim 6, said winding roller being a first winding roller, further comprising a second winding roller being spaced from and driven by said first winding roller.

8. A fiber bale opener as defined in claim 7, further comprising a freewheel interposed between and operatively connected with said motor means and said second winding roller for rotating said second winding roller solely in an unwinding direction of said cover belt.

9. A fiber bale opener as defined in claim 7, further comprising a brake means operatively connected with said second winding roller for braking said second winding roller during unwinding of said cover belt from said core.

10. A fiber bale opener as defined in claim 6, further comprising a step-up gear between said deflection roller and said first winding roller.

11. A fiber bale opener as defined in claim 1, further comprising a counter support roller for holding said lower section of said cover belt, positioned between said deflection roller and said fixed end of said cover belt, on said suction duct.

12. A fiber bale opener as defined in claim 1, wherein said winding and unwinding device is stationary.

13. A fiber bale opener as defined in claim 1, wherein said cover belt is formed of longitudinally adjoining first and second halves; said first half terminating in said one end fixed at one end of said traveling path; said second half terminating in another end attached to said core; said first longitudinal half being stable with respect to tension forces and said second longitudinal half being stable with respect to tension and transverse forces.

14. A fiber bale opener as defined in claim 1, further comprising a tensioning roller in engagement with said cover belt between said deflection roller and said winding and unwinding device.

15. In a fiber bale opener including a truck arranged for back-and-forth movement along a traveling path, an opening mechanism carried by said truck for removing fiber material from fiber bales and a suction apparatus including a stationary suction duct having a length extending in the direction of said traveling path and a throughgoing slot on one side thereof, extending parallel to said length, a flexible cover belt extending over said slot for sealing the inside of said duct from the environment, said cover belt defining an interstice within said truck; said interstice traveling with said truck and providing a passage for the fiber-like material to pass inside of said suction duct; a deflection means mounted on said truck at the interstice; said cover belt being positioned above said slot and being guided around said deflection means; said cover belt having one end fixed at one end of said traveling path; the improvement comprising a winding and unwinding device situated at a distance from said deflection means; said device including a core around which said cover belt can be wound; said cover belt having a length portion extending from said deflection means to said device and being connected to said core.

16. A fiber bale opener as defined in claim 15, wherein said winding and unwinding device is stationarily supported, whereby said truck, upon travel thereof, moves towards or away from said winding and unwinding device.

17. In a fiber bale opener including a truck arranged for back-and-forth movement along a traveling path, an opening mechanism carried by said truck for removing fiber material from fiber bales and a suction apparatus including a stationary suction duct having a length extending in the direction of said traveling path and a throughgoing slot on one side thereof, extending parallel to said length, a flexible cover belt extending over said slot for sealing the inside of said duct from the environment, said cover belt defining an interstice traveling with said truck and providing a passage for the fiber-like material to pass inside of said suction duct; said cover belt being positioned above said slot and having one end fixed at one end of said traveling path; the improvement comprising a winding and unwinding device traveling with said truck; said device including a core around which said cover belt can be wound; said cover belt being connected to said core.

18. In a fiber bale opener including a truck arranged for back-and-forth movement along a traveling path, an opening mechanism carried by said truck for removing fiber material from fiber bales and a suction apparatus including a stationary suction duct having a length extending in the direction of said traveling path and a throughgoing slot on one side thereof, extending parallel to said length, a flexible cover belt extending over said slot for sealing the inside of said duct from the environment, said cover belt defining an interstice traveling with said truck and providing a passage for the fiber-like material to pass inside of said suction duct; said cover belt being positioned above said slot and having one end fixed at one end of said traveling path; the improvement comprising a winding and unwinding device; said device being stationarily supported, whereby said truck, upon travel thereof, moves towards or away from said device; said device including a core around which said cover belt can be wound; said cover belt being connected to said core.

* * * * *